United States Patent [19]

Matsui et al.

[11] Patent Number: 4,936,084

[45] Date of Patent: Jun. 26, 1990

[54] YARN UNTWISTING DEVICE IN SPLICING APPARATUS

[75] Inventors: Isamu Matsui, Kyoto; Hiroshige Maruki, Kusatsu, both of Japan

[73] Assignee: Murata Kikai Kabushiki Kaisha, Kyoto, Japan

[21] Appl. No.: 334,092

[22] Filed: Apr. 5, 1989

[30] Foreign Application Priority Data

Apr. 9, 1988 [JP] Japan ..... 63-87722
Apr. 9, 1988 [JP] Japan ..... 63-87723

[51] Int. Cl.[5] ..... D01H 13/30; D01H 15/00

[52] U.S. Cl. ..... 57/22; 57/1 UN; 57/295

[58] Field of Search ..... 57/1 UN, 22, 261, 263, 57/295, 350

[56] References Cited

U.S. PATENT DOCUMENTS 4,428,992 1/1984 Street ..... 57/22 X
4,492,076 1/1985 Romic et al. ..... 57/22
4,506,497 3/1985 Feuerlohn ..... 57/22
4,565,058 1/1986 Rohner et al. ..... 57/22
4,573,313 3/1986 Bertrams ..... 57/22
4,577,458 3/1986 Garnsworthy ..... 57/22
4,608,816 9/1986 Bertrams et al. ..... 57/22
4,610,133 9/1986 Rohner et al. ..... 57/22
4,653,258 3/1987 Rohner ..... 57/22
4,676,055 6/1987 Nishimura ..... 57/22
4,765,128 8/1988 Rosen et al. ..... 57/22

*Primary Examiner*—Joseph J. Hail, III
*Attorney, Agent, or Firm*—Spensley, Horn, Jubas & Lubitz

[57] ABSTRACT

A yarn untwisting device in a pneumatic yarn splicing apparatus which includes an untwisting nozzle for guiding an end of cut yarn; a gas feed device for feeding a gas stream into the nozzle; a liquid feed device for spraying liquid to the yarn end which has been sucked into the nozzle; and a liquid recovering device connected to the nozzle.

4 Claims, 3 Drawing Sheets

YARN UNTWISTING DEVICE IN SPLICING APPARATUS

FIELD OF THE INVENTION

The present invention relates to a yarn untwisting device in a splicing apparatus, particularly an untwisting device capable of untwisting sized yarn easily.

RELATED ART STATEMENT

Usually, warps on a weaving machine are sized in order to enhance the yarn strength. Heretofore, in the event of warp breakage, tying has been performed manually.

In place of such manual tying, if splicing is performed using such pneumatic splicing apparatus as shown in Japanese Patent Publication Nos. 47108/81 and 3742/87, it is convenient because splicing can be done quickly without knot.

According to the above splicing apparatus, after untwisting of yarn ends, the untwisted yarn ends are spliced together while being turned by a swirling current of air. However, since the warps referred to above are sized, it has been impossible for the said splicing apparatus to untwist the yarn end and so impossible to effect splicing.

OBJECT AND SUMMARY OF THE INVENTION

It is an object of the present invention to provide a yarn end untwisting device in a splicing apparatus, capable of untwisting sized yarn easily and permitting the splicing apparatus to splice sized yarns together.

In order to achieve the above-mentioned object, embodiments of the present invention includes an untwisting nozzle for guiding an end of cut yarn; a gas feed means for feeding a gas stream into the nozzle; a liquid feed means for spraying liquid to the yarn end which has been sucked into the nozzle; and a liquid recovering means connected to a downstream side of the nozzle for recovering the liquid scattered within the nozzle.

Further, the untwisting nozzle is provided with a heating means for evaporating the liquid adhered to the interior of the nozzle.

When a gas stream is fed into the untwisting nozzle by the gas feed means, the end of cut yarn is sucked into the nozzle. Then, liquid is sprayed to the yarn end thus sucked in the nozzle by the liquid feed means. Where the yarn is a sized yarn, the size is dissolved by the liquid, thus facilitating untwisting. Consequently, it becomes possible to splice sized yarns using the splicing apparatus. The extra liquid scattered in the nozzle is recovered by the liquid recovering means connected to a downstream side of the nozzle.

Additionally, since the untwisting nozzle is provided with the heating means, the liquid adhered to the interior of the nozzle is evaporated.

DETAILED DESCRIPTION OF PREFERRED EMBODIMENTS

An embodiment of the present invention will be described in detail hereinunder with reference to the accompanying drawings.

Figure 2:
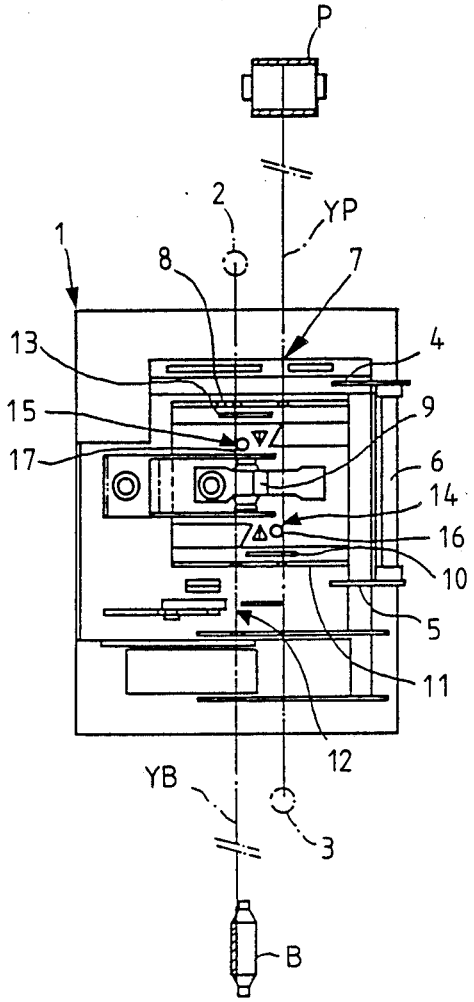
FIG. 2 is a front view of the splicing apparatus.

FIG. 2 illustrates a pneumatic yarn splicing apparatus 1 provided in an automatic winder. Above and under the splicing apparatus 1 there are disposed a package P and a bobbin B, respectively. The splicing apparatus 1 is provided with suction arms 2 and 3, whereby in the event of breakage of yarn (sized yarn) extending from the bobbin B to the package P, a bobbin-side yarn YB and a package-side yarn YP are sucked in and held, then conducted to the front of the splicing apparatus 1, through a mechanism (not shown). On one side of the splicing apparatus 1 there are disposed yarn handling levers 4 and 5 rotatably through a shaft 6 for handling the yarns YB and YP which have been conducted to the front of the splicing apparatus 1 by the suction arms 2 and 3 and guiding them more inside. The yarn YP passes through a clamping device 7, a right-hand slot of a fork guide 8, a splicing hole 9, a yarn cutter 10 and a right-hand slot of a fork guide 11, which are provided in the splicing apparatus 1, and reaches the suction pipe 3. On the other hand, the yarn YB passes through a clamping device 12, a left-hand slot of the fork guide 11, the splicing hole 9, the yarn cutter 13 and a left-hand slot of the fork guide 8, which are provided in the splicing apparatus 1, and reaches the suction pipe 2. The clamping devices 7 and 12 function to grip the yarns YP and YB, while the yarn cutters 10 and 13 function to cut the gripped yarns YP and YB. Ends of the cut yarns YP and YB are conducted to untwisting nozzles 16 and 17 of untwisting devices 14 and 15 which are disposed in proximity to each other.

Figure 1:
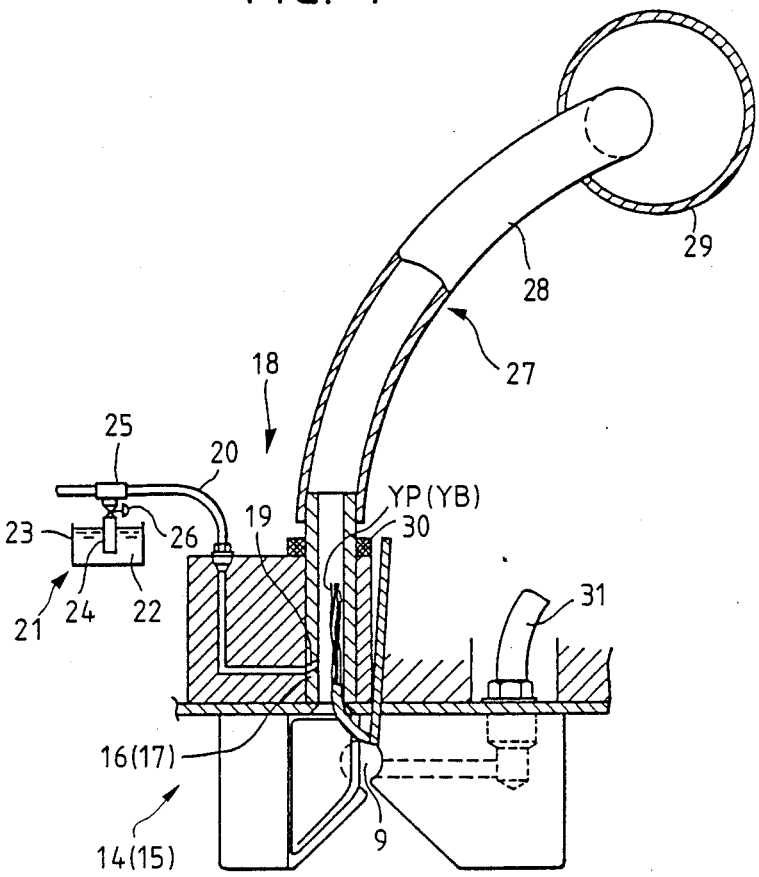
FIG. 1 is a transverse sectional view showing an embodiment of a yarn untwisting device in a splicing apparatus according to the present invention.

FIG. 1 illustrates the untwisting device 14 on the sized yarn YP side in the splicing apparatus. The untwisting nozzle 16 of the untwisting device 14 is a cylinder having an inside diameter larger than the diameter of the sized yarn YP for conducting the end of the yarn YP therethrough. The untwisting nozzle 16 is provided with a gas feed means 18 for sucking in the end of the sized yarn YP. The gas feed means 18 comprises a jet hole 19 formed through the untwisting nozzle 16, a feed pipe 20 connected to the jet hole 19, and a pressurized air source (not shown) connected through the feed pipe 20. The jet hole 19 extends through the untwisting nozzle 16 obliquely and inwardly from an opening of the nozzle to eject a rotating current of air. The gas feed means 18 is provided with a liquid feed means 21 for spraying liquid to the end of the sized yarn YP which has been sucked into the untwisting nozzle 16. The liquid feed means 21 comprises a tank 23 of a liquid 22 for dissolving the size of the sized yarn YP, a suction pipe 24 for sucking the liquid 22 from the interior of the tank 23, an injector 25 attached to the feed pipe 20, and an on-off valve 26 attached to the suction pipe 24. As the liquid 22 there is used for example, water, warm water, or a solution (e.g. caustic soda solution plus lactogen) which dissolves the size. To the feed pipe 20 is fed air under pressure from the foregoing pressure source during the period from when the yarn cutters 10 and 13 started operation until when splicing is started. The on-off valve 26 is controlled so as to be closed before the supply of the pressurized air is stopped. Further, to the tip portion of the untwisting nozzle 16 is connected a liquid recovering means 27 for recovering the liquid scattered in the interior of the nozzle 16. The liquid recovering means 27, connected to the tip of the nozzle 16, comprises a downwardly curved hose 28 and a bottomed, cylindrical, recovery tank 29 which is connected to the nozzle through the hose 28. Near the connection with the hose 28, a heating means 30 is disposed along the outer periphery of the untwisting nozzle 16 to evaporate the liquid adhered to the nozzle interior. The heating means 30 is constituted by a heating coil for example and it is connected to a power source (not shown).

The yarn handling levers 4 and 5 further turn after the end of untwisting of the ends of the sized yarns YP and YB to arrange the yarn ends in the splicing hole 9, which hole is connected to a pressure source (not shown) through a pipe 31.

The untwisting device 15 on the sized yarn YB side is also of the same construction as above.

The operation of the above embodiment will be described below.

Since a rotating current of air is fed into the untwisting nozzles 16 and 17 by the gas feed means 18 through the jet hole 19 thereof, the ends of the sized yarns YP and YB which has been cut by the yarn cutters 10 and 13, respectively, are sucked into the untwisting nozzles 16 and 17. To the ends of the sized yarns YP and YB thus sucked in are not only ejected the pressurized air by the gas feed means 18 but also mistily sprayed the liquid 22 through the on-off valve 26 now in an open condition of the liquid feed means 21, so that the size adhered to the yarn ends are dissolved, whereby the yarn ends are untwisted. Under control of the on-off valve 26, the pressurized air is still fed into the untwisting nozzles 16 and 17 for a while after spraying of the liquid 22, so that the yarn ends are dried and the untwisting is effected to a satisfactory extent. Then, the ends of the sized yarns YP and YB thus untwisted are arranged in the splicing hole 9 and spliced by the action of the rotating air current.

Thus, since the ends of the sized yarns are untwisted after the size is dissolved or decomposed by spraying the liquid thereto, it is possible to effect untwisting easily even in case of sized yarns, and hence sized yarns can be spliced together using the splicing apparatus. Moreover, since sized yarns can thus be spliced together using the splicing apparatus, it becomes possible to install in a weaving machine a splicing apparatus for splicing warps used in the weaving machine. Further, the spraying of the liquid is performed within the untwisting nozzles 16 and 17, there is no fear of the liquid being scattered to stain the exterior.

After the splicing operation, a test was made to check the yarn strength of the joint portion; as a result, the joint proved to have a high strength. It also turned out that by allowing a small amount of size to remain at the yarn ends at the time of dissolving off the size there could be attained a higher yarn strength because of the size becoming hard after splicing.

Also as to other yarns than sized yarns, for example yarn of high stiffness, it is possible to soften the yarn by spraying liquid against it in advance to improve entanglement during splicing.

Further, the mass of yarn is increased by the adhesion of liquid thereto, whereby yarn motions (e.g. rotation and untwisting) are promoted, thus ensuring strong twisting and affording a strong joint.

Extra liquid scattered within the untwisting nozzles 16 and 17 is received into the recovery tank 29 through the hose 28 of the liquid recovering means 27 connected to the downstream side of each of the nozzles 16 and 17. Thus, since the liquid 22 is sprayed to end portions of the sized yarns YP and YB within the untwisting nozzles 16 and 17 and recovered by the liquid recovering means 26, it is possible to prevent rusting of peripheral equipment.

Additionally, since the untwisting nozzles 16 and 17 are each provided with the heating means 30, even if liquid adheres to the interiors of the nozzles 16 and 17, it will be evaporated by the heat generated by those heating means to prevent the ends of the sized yarns YP and YB from adhering to the interiors of the nozzles 16 and 17, thus preventing rusting of both nozzles themselves.

Another embodiment of the present invention will be described referring to FIG. 3.

Figure 3:
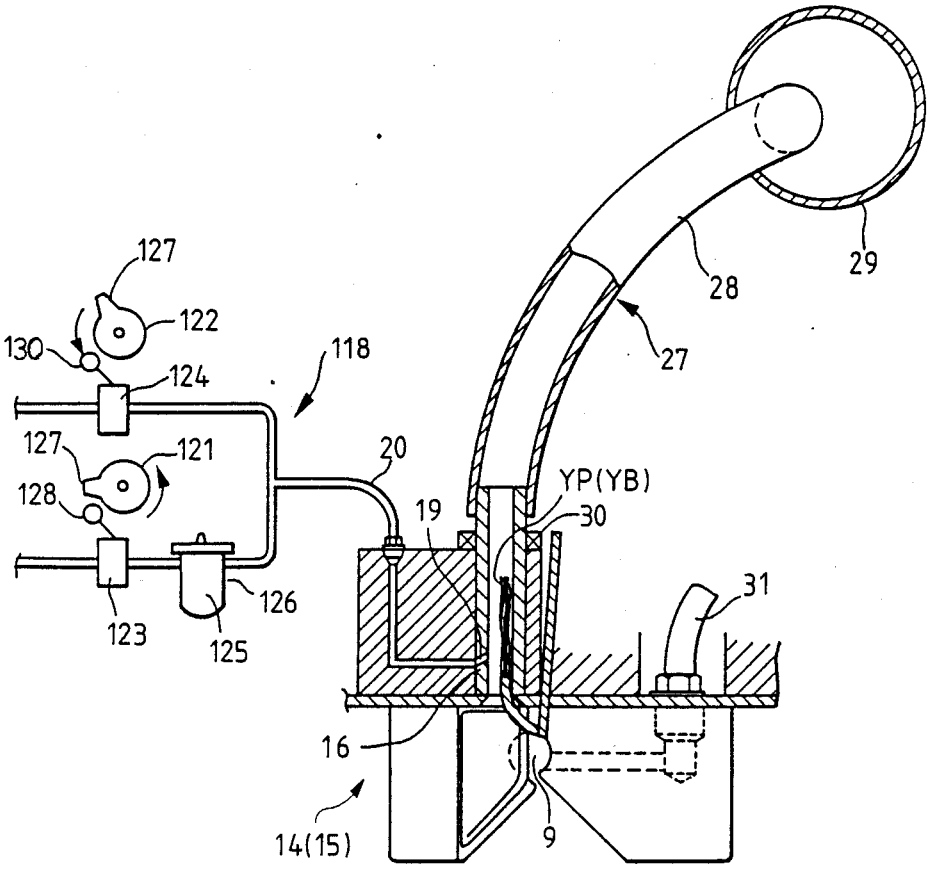
FIG. 3 is a transverse sectional view showing another embodiment of a yarn untwisting device of the present invention.

FIG. 3 illustrates another embodiment of the untwisting device 14 on the sized yarn YP side in the splicing apparatus 1 shown in FIG. 2.

The untwisting nozzle 16 of the untwisting device 14 is a cylinder having an inside diameter larger than the diameter of the sized yarn YP for conducting the end of the yarn YP therethrough. The untwisting nozzle 16 is provided with a gas-liquid feed means 118 for ejecting a liquid and a pressurized gas selectively into the nozzle interior. The gas-liquid feed means 118 comprises a jet hole 19 formed through the untwisting nozzle 16; a bifurcated feed pipe 20 connected to the jet hole 19; a pressurized air source (not shown) connected through the feed pipe 20 to the extending ends thereof; on-off valves 123 and 124 attached to the bifurcated portions of the feed pipe 20 and opened and closed by cams 121, 122, respectively; and a liquid tank 126 provided on a downstream side of the on-off valve 123 and containing a liquid 125 for dissolving size. The jet hole 19 extends through the untwisting nozzle 16 obliquely toward the tip of the nozzle to eject a rotating current of air. The liquid tank 126 is provided with a suction pipe (not shown) for sucking the liquid 125 and an injector (not shown) attached to the feed pipe 20. As the liquid 125 there is used, for example, water, warm water, or a solution (e.g. caustic soda solution plus lactogen) which dissolves the size. The on-off valves 123 and 124 are opened with levers 128 and 130 which are actuated by projections 127 and 129 of the cams 121 and 122, respectively. For example, the cams 121 and 122 are provided coaxially with the yarn handling levers 4 and 5. They are mounted at different timings so that after the on-off valve 123 on the liquid tank 123 side is opened, the other on-off valve 124 is opened.

To the feed pipe 20 is fed air under pressure from the foregoing pressure source during the period from when the yarn cutters 10 and 13 started operation until when splicing is started. To the tip portion of the untwisting nozzle 16 is connected a liquid recovering means 29 for recovering the liquid fed by the gas-liquid feed means 118 and scattered in the nozzle. The liquid recovering means 27, connected to the tip of the nozzle 16, comprises a downwardly curved hose 28 and a bottomed, cylindrical, recovery tank 29 which is connected to the nozzle through the hose 28. Near the connection with the hose 28, a heating means 30 is disposed along the outer periphery of the untwisting nozzle 16 to evaporate the liquid adhered to the nozzle interior. For example, the heating means 30 is constituted by a heating coil and is connected to a power source (not shown).

The yarn handling levers 4 and 5 further turn after the end of untwisting of the ends of the sized yarns YP and YB to arrange the yarn ends in the splicing hole 9, which hole is connected to a pressure source (not shown) through a pipe 31.

The untwisting device 15 on the sized yarn YB side is also of the same construction as above.

The operation of the above embodiment will be described below.

The ends of the sized yarns YP and YB which have been cut by the yarn cutters 10 and 13 are sucked into the untwisting nozzles 16 and 17, respectively. The projection 127 of the cam 121 actuates the lever 128 to open the on-off valve 123, whereby the liquid 125 from the liquid tank 126 is mistily sprayed to the yarn ends of the sized yarns YP and YB thus sucked in, so that the size adhered to the yarn ends is dissolved and the yarn ends are untwisted. The thus-untwisted yarn ends of the sized yarns YP and YB are arranged in the splicing hole 9 and spliced by the action of the rotating air current.

Next, since the other cam 122 is mounted at a timing different from that of the cam 121, the projection 129 of the cam 122 actuates the lever 130 to open the other on-off valve 124, whereupon pressurized air is injected into the untwisting nozzles. Extra liquid scattered within the untwisting nozzles 16 and 17 after fed by the gas-liquid feed means 18 for untwisting the sized yarn YP is blown off by the pressurized air and is received into the recovery tank 29 through the hose 28 of the liquid recovering means 27 which is connected to the downstream side of each of the nozzles 16 and 17. Thus, since the liquid 125 is sprayed to the ends of the sized yarns YP and YB within the untwisting nozzles 16 and 17 and then recovered by the liquid recovering means 27, it is possible to prevent rusting of the peripheral equipment.

The on-off valve 124 for ejecting the pressurized air into the untwisting nozzles 16 and 17 may be set so as to open periodically separately from the operation of the yarn handling levers 4 and 5.

What is claimed is:

1. A yarn untwisting device in a yarn splicing apparatus, comprising:

an untwisting nozzle for guiding an end of cut yarn;

a gas-liquid feed means for feeding a liquid and a pressurized gas into said nozzle; and a liquid recovering means connected to a downstream side of said nozzle for recovering the liquid scattered within the nozzle, said liquid recovering means comprises a hose connected to the tip of the nozzle and a recovery tank which is connected to the nozzle through the hose;

wherein said untwisting nozzle is provided with a heating means for evaporating the liquid adhered to the interior of the nozzle, said heating means is disposed along the outer periphery of the untwisting nozzle near the connection with the hose.

2. The yarn untwisting device as claimed in claim 1, wherein said gas-liquid feed means comprises a jet hole formed through the untwisting nozzle, and extending obliquely toward a tip of the nozzle, a feed pipe connected to the jet hole and connected to a pressurized air source at another end thereof, and a liquid tank connected to the feed pipe through an injector, said tank being connected to the injector by a suction pipe having an on-off valve attached thereto.

3. A yarn untwisting device in a yarn splicing apparatus, comprising:

an untwisting nozzle for guiding an end of cut yarn;

a gas-liquid feed means for feeding a liquid and a pressurized gas into said nozzle; and a liquid recovering means connected to a downstream side of said nozzle for recovering the liquid scattered within the nozzle;

wherein said gas-liquid feed means comprises a jet hole formed through the untwisting nozzle and extended obliquely toward a tip of the nozzle, a bifurcated feed pipe connected to the jet hole, a first pipe bifurcated from the feed pipe and connected to a pressurized air source, said first pipe being provided with a first on-off valve which is operated by a first cam, and second pipe bifurcated from the feed pipe and connected to a pressurized air source, said second pipe being provided with a second on-off valve which is operated by a second cam and a liquid tank operatively connected with the untwisting nozzle to supply liquid into the untwisting nozzle, said liquid tank is connected to the second pipe through an injector.

4. The yarn untwisting device as claimed in claim 3, wherein said first and second cams are mounted at different timing so that after the second on-off valve on the liquid tank side is opened, the first on-off valve is opened.

* * * * *